United States Patent [19]

Ozeki

[11] Patent Number: 4,524,892

[45] Date of Patent: Jun. 25, 1985

[54] HANGER ATTACHMENT

[76] Inventor: Isamu Ozeki, 32, Yoshida-machi, Seki-shi, Gifu-ken, Japan

[21] Appl. No.: 547,856

[22] Filed: Nov. 2, 1983

[30] Foreign Application Priority Data

Jul. 8, 1983 [JP] Japan ..... 58-106680[U]

[51] Int. Cl.[3] ..... A45F 5/02

[52] U.S. Cl. ..... 224/256; 224/232; 224/904

[58] Field of Search ..... 2/300; 224/232, 269, 224/256, 255, 268, 904, 908, 240, 242, 914, 907, 909, 271, 269, 225, 224, 151, 101; 24/3 R

[56] References Cited

U.S. PATENT DOCUMENTS

| | | | |
|---|---|---|---|
| 954,765 | 4/1910 | Rune | 224/907 X |
| 3,361,312 | 1/1968 | Hutchison | 224/240 |
| 3,956,795 | 5/1976 | Kosakai | 24/3 R |
| 4,166,557 | 9/1979 | Conley | 224/101 |
| 4,326,652 | 4/1982 | Fortenberry | 224/232 |
| 4,358,036 | 11/1982 | Maltais | 224/255 X |

FOREIGN PATENT DOCUMENTS

| | | |
|---|---|---|
| 54-117599 | 1/1978 | Japan . |
| 5786176 | 11/1980 | Japan . |

*Primary Examiner*—Stephen Marcus
*Assistant Examiner*—Robert Petrik
*Attorney, Agent, or Firm*—Leydig, Voit, Osann, Mayer & Holt, Ltd.

[57] ABSTRACT

A hanger attachment for use with a knife holder having an attachment loop to be hung from a trousers' belt comprises a support member having a groove receptive of the belt therein, and a hook member detachably mounted on the support member for removably supporting the attachment loop of the knife holder.

1 Claim, 7 Drawing Figures

HANGER ATTACHMENT

BACKGROUND OF THE INVENTION

1. Field of the Invention

The present invention relates to a hanger attachment for use with a knife holder, a pocket case of leather, a whistle band, or a rope swivel joint, for example.

2. Description of the Prior Art

For attachment of a knife holder to a trousers' belt, it is customary practice to insert the belt through a belt insertion slit defined in the back of the knife holder, thus allowing the knife holder to hang from the belt. Therefore, each time the knife holder is to be detached, it is necessary to remove the belt. Attachment and removal of the knife holder to and from the belt is quite cumbersome to accomplish.

SUMMARY OF THE INVENTION

It is an object of the present invention to provide a hanger attachment for use with knife holders, for example, which can easily be attached to and removed from different types of knife holders, can be attached to and detached from a belt without the need for removal of the belt from trousers, and allows the knife holder to be attached to other garments and items than trousers' belts.

According to the present invention, there is provided a hanger attachment for use with a knife holder, for example, having an attachment loop to be hung from a trousers' belt, for example. The hanger attachment comprises a support member having a groove receptive of the belt therein, and a hook member detachably mounted on the support member for removably supporting the attachment loop of the knife holder.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
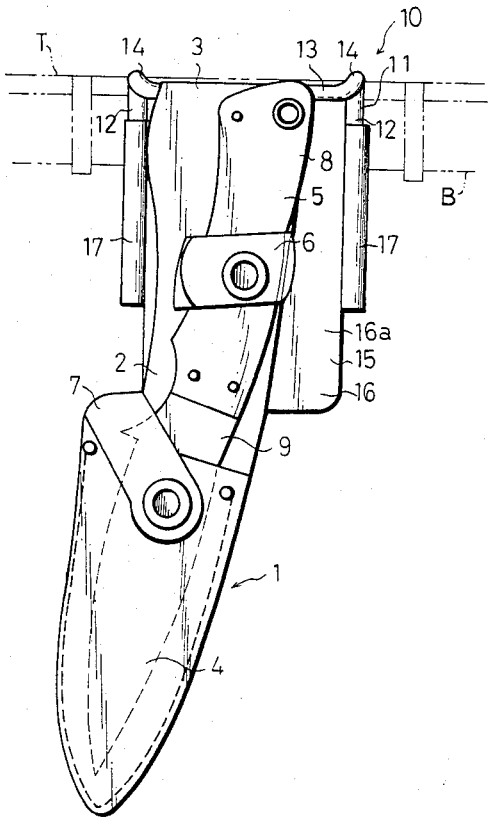
FIG. 1 is a front elevational view of a hanger attachment according to the present invention, as attached to a knife holder holding a knife.

The principles of the present invention are particularly useful when embodied in a hanger attachment, generally indicated by the reference numeral 10, for use with a knife holder as shown in FIGS. 1 through 4.

Figure 2:
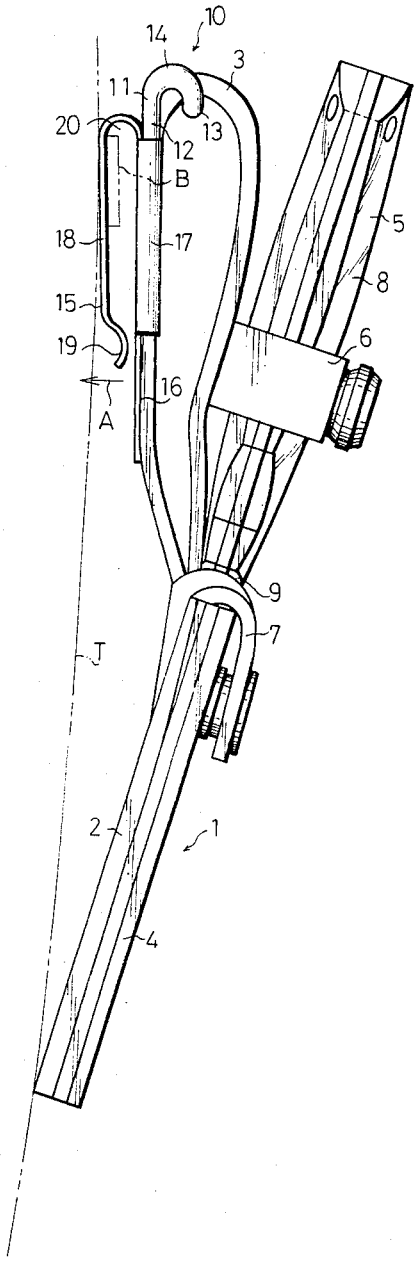
FIG. 2 is an enlarged side elevational view of FIG. 1.

As illustrated in FIGS. 1 and 2, a knife holder 1 is made of leather and comprises an inner layer 2 having an upper end folded into a loop 3. The knife holder 1 also includes an outer layer 4 sewn to the inner layer 2 along their outer peripheral edges. The outer layer 4 has an upper edge separated from the inner layer 2. A knife 5 has a blade inserted between the inner and outer layers 2, 4 through a gap defined between the upper edge of the outer layer 4 and the inner layer 2. A pair of holder belts 6, 7 is attached to upper and central portions, respectively, of the inner layer 2 for holding a handle 8 and a choil 9 of the knife 5 against the knife holder 1.

Figure 3A:
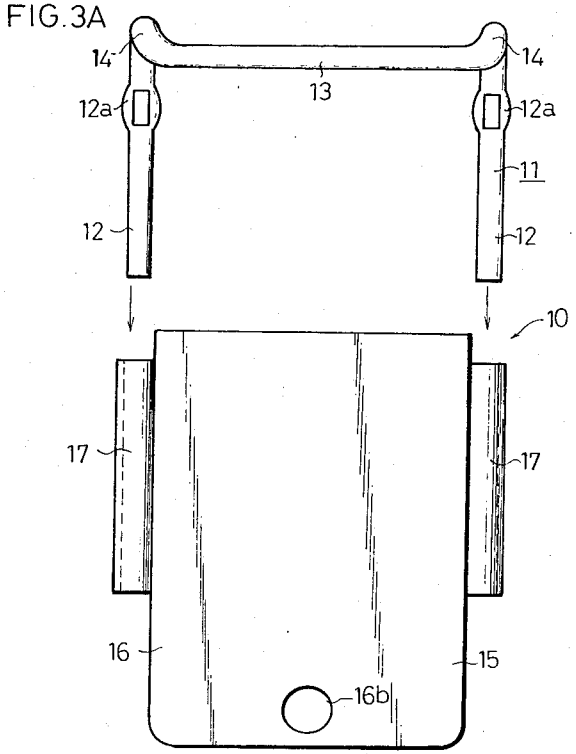
FIG. 3A is an enlarged exploded front elevational view of the hanger attachment.

The hanger attachment 10 is attached to the loop 3 of the knife holder 1 and is made of metal. As shown in FIG. 3A, the hanger attachment 10 is composed of a hook member 11 in the form of a single round rod of metal bent substantially into a U shape as seen in front elevation. The hook member 11 has a pair of insertion shanks 12 extending downwardly from the opposite ends of a horizontal support shank 13. The insertion shanks 12 have a pair of enlarged portions **12*a*, respectively, formed by being flattened by a punch, for example. The horizontal support shank 13 has its opposite ends slightly raised to provide a pair of positioning shoulders 14 for preventing the loop 3** from being shifted sideways.

Figure 3B:
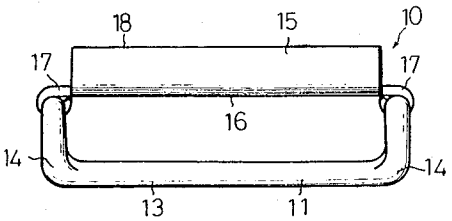
FIG. 3B is an enlarged plan view of the hanger attachment.

The hanger attachment 10 also includes a support member 15 in the form of a single plate bent into an inverted U shape as seen in side elevation. The support member 15 includes an outer side panel 16 having a pair of cylindrical side insertion tubes 17 as shown in FIG. 3B and a central hole **16*b* (FIG. 3A). As illustrated in FIG. 2, the support member 15 further includes an inner side panel 18 having a lower end bent toward the outer side panel 16 to provide a locking portion 19. The outer and inner side panels 16, 18 of the support member 15 jointly define a groove 20** for insertion of a belt B therein.

The hanger attachment 10 thus constructed will be used as follows:

For attaching the hanger attachment 10 to the knife holder 1, the hook member 11 and the support member 15 are separated from each other, and the hook member 11 is inserted through the loop 3 of the knife holder 1 until the support shank 13 is positioned in the loop 3. By forcibly inserting the shanks 12 of the hook member 11 into the tubes 17, respectively, of the support member 15, the enlarged portions **12*a* are pushed into the tubes 17 until the hook member 11 and the support member 15 are securely coupled together. The upper end of the loop 3 of the knife holder 1 is positioned on the support shank 13 of the hook member 11, and the loop 3 is prevented by the positioners 14 from being laterally shifted to a large extent. Thus, the hanger attachment 10 can be attached to the knife holder 1** with utmost ease.

The hanger attachment 10 is then attached to the belt B, for example, in the following manner: The lower end of the inner side panel 18 of the support member 15 is slightly displaced resiliently inwardly in the direction of the arrow A (FIG. 2), and the belt B is inserted from below between the locking portion 19 and the outer side panel 16 while the hanger attachment 10 is lowered until the belt B is received in the groove 20. The hanger attachment 10 is now mounted on the belt B as shown in FIGS. 1 and 2. When the lower end of the inner side panel 18 of the support member 15 is released, the locking portion 19 springs back toward the outer side panel 16. The locking portion 19 can now prevents the belt B from being slipped downwardly out of the groove 20 while the knife holder 1 is being worn by the user.

When the hanger attachment 10 is to be detached from the belt B, the hanger attachment 10 is forcibly pulled upwardly to cause the belt B to engage and spread the locking portion 19 and the outer side panel 16 apart from each other, whereupon the hanger attachment 10 is removed upowardly out of engagement with the belt B. Consequently, there is no need for removal of the belt B from trousers T each time the hanger attachment 10 is to be attached or detached.

The hanger attachment 10 can be attached to an upper edge of the trousers T, for example, rather than the belt B, simply by inserting the upper edge of the trousers T between the locking portion 19 and the outer side panel 16 while lowering the hanger attachment 10. Since the upper edge of the trousers T is gripped between the locking portion 19 and the outer side panel 16, there is no danger of the hanger attachment 10 to be accidentally released upwardly off the trousers T.

Since the hook member 11 of the hanger attachment 10 is in the form of a round rod, it does not damage the inner surface of the loop 3 of the knife holder 1.

Figure 4:
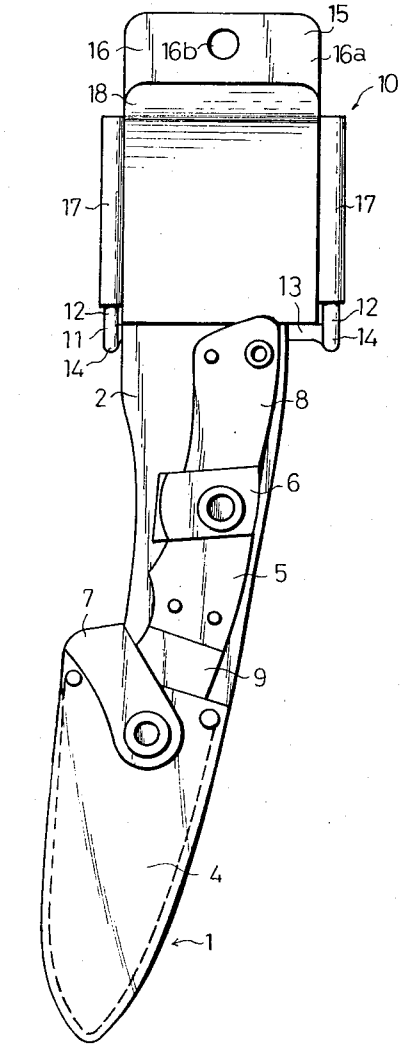
FIG. 4 is a front elevational view of the hanger attachment with the knife holder being not carried by the user.

While the knife holder 1 is not in use, the hanger attachment 10 is turned upwardly about the support shank 13 of the hook member 11 as shown in FIG. 4, and the support member 15 may be hooked on a nail or hook on a wall such that the nail or hook is inserted through the hole 16*b*, thus allowing the knife holder 1 to hang on the wall. The hook member 11 is prevented from being released off the support member 15 because the enlarged portions 12*a* of the hook member 11 are tightly fitted in the tubes 17, respectively, of the support member 15.

When the knife holder 1 is to be kept out of use outdoors, a string may be threaded through the hole 16*b* in the support member 15 and tied at an end to a tree branch, for example, letting the knife holder 1 hang for safe storage of the knife 5.

As the hook member 11 can be removed from the support member 15 by being forcibly pulled upwardly, the hook member 11 can hang other types of knife holders having attachment loops similar to the loop 3, or other objects than the knife holders, such as pocket cases of leather, whistle bands, rope swivel joints, and the like.

The enlarged portions 12*a* may be dispensed with by increasing the diameter of the insertion shanks 12 of the hook member 11 so as to be substantially equal to the inside diameter of the tubes 7 for tight fitting engagement therein.

Figure 5A:
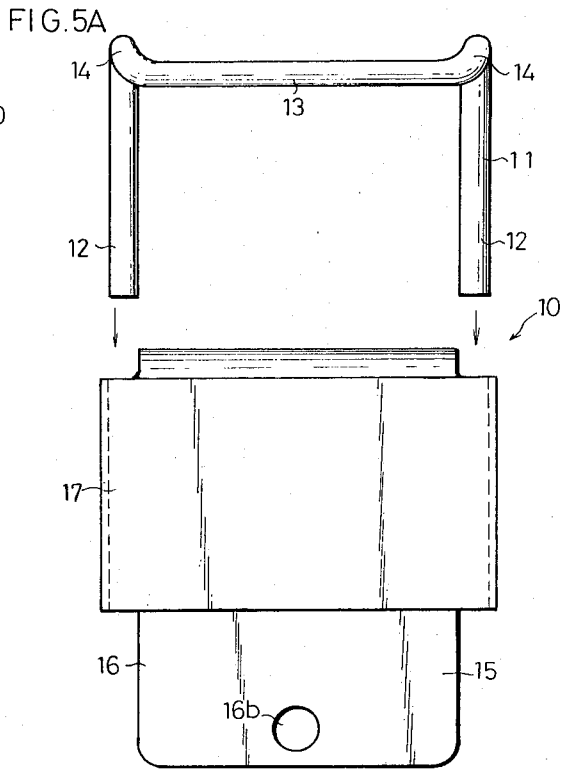
FIG. 5A is an enlarged exploded front elevational view of a hanger attachment according to another embodiment.
Figure 5B:
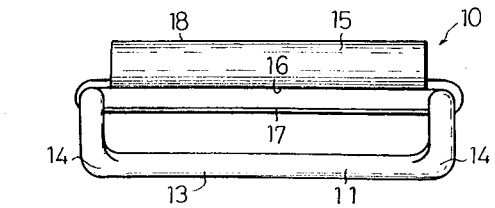
FIG. 5B is an enlarged plan view of the hanger attachment shown in FIG. 5A.

According to a modifition shown in FIGS. 5A and 5B, a support member 15 has a single laterally extending tube 17 receptive of the insertion shanks 12.

The support member 15 of the hanger attachment 10 may be molded of synthetic resin.

With the arrangement of the present invention, the hanger attachment can easily be attached to and removed from knife holders of different designs and allows knife holders to be attached to belts without having to remove the latter from trousers or the like. In addition, the hanger attachment is capable of mounting knife holders on other garments or items than belts.

Although certain preferred embodiments have been shown and described, it should be understood that many changes and modifications may be made therein without departing from the scope of the appended claims.

What is claimed is:

1. A hanger attachment for use with an article having an attachment loop to be hung from an attachment item, comprising:

(a) a support member having a groove receptive of the attachment item therein, said groove formed by bending said support member into a U shape with an inner side panel and an outer side panel parallel thereto, said inner side panel having its lower end bent toward said outer side panel and serving as a locking portion and said outer panel having a pair of cylindrical insertion tubes formed from the opposite edges thereof; and (b) a hook member comprising a metal round rod which is first bent into a U shape having a horizontal support shank and a pair of insertion shanks extending vertically downward from opposite ends of said horizontal support shank, and which is further bent to provide a pair of positioning shoulders at the ends of said horizontal support shank, said hook member being detachably mounted on said support member by telescoping said insertion shanks, which have enlarged portions thereon, downwardly into said cylindrical insertion tubes so that said horizontal support shank is disposed above said insertion tubes, said horizontal support shank thereby removably supporting the attachment loop of the article such that the attachment loop hangs from said horizontal support shank and is prevented from shifting sideways thereon by said positioning shoulders.

* * * * *